US012357072B2

(12) United States Patent
Yang

(10) Patent No.: US 12,357,072 B2
(45) Date of Patent: Jul. 15, 2025

(54) AIRTIGHT LOOSE POWDER CONTAINER

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 260 days.

(21) Appl. No.: 17/866,589

(22) Filed: Jul. 18, 2022

(65) Prior Publication Data

US 2023/0354984 A1 Nov. 9, 2023

(30) Foreign Application Priority Data

May 5, 2022 (CN) ..... 202210482941.8

(51) Int. Cl.
*A45D 33/24* (2006.01)
*A45D 33/00* (2006.01)
*A45D 33/02* (2006.01)

(52) U.S. Cl.
CPC ..... *A45D 33/24* (2013.01); *A45D 33/003* (2013.01); *A45D 33/025* (2013.01); *A45D 2200/051* (2013.01)

(58) Field of Classification Search
CPC .... A45D 33/003; A45D 33/24; A45D 33/025; A45D 2200/051; A45D 40/22
See application file for complete search history.

(56) References Cited

U.S. PATENT DOCUMENTS

2001/0022185 A1 9/2001 Yuhara et al.
2017/0006996 A1* 1/2017 Kim ..... A45D 33/025

FOREIGN PATENT DOCUMENTS

CN 106028867 A 10/2016
CN 206909972 U * 1/2018
CN 217937468 U 12/2022
JP H10192044 A 7/1998

* cited by examiner

*Primary Examiner* — Anthony D Stashick
*Assistant Examiner* — L Kmet
(74) *Attorney, Agent, or Firm* — Bayramoglu Law Offices LLC

(57) ABSTRACT

An airtight loose powder container includes an outer lid, an inner lid, an inner sifter and a base. The inner sifter is airtightly provided at an open end of the base, and the inner sifter is located between the inner lid and the base. The inner lid and the inner sifter are hinged through a hinge unit. The hinge unit is elastic, such that the inner lid under stress can move toward the inner sifter. When the outer lid covers the base, the outer lid squeezes the inner lid, such that the inner lid is airtightly attached to the inner sifter. The inner lid and the inner sifter hinged with each other are provided in the container. Under the squeezing force of the outer lid, the inner lid and the inner sifter can be tightly attached to each other.

8 Claims, 12 Drawing Sheets

AIRTIGHT LOOSE POWDER CONTAINER

CROSS REFERENCE TO THE RELATED APPLICATIONS

This application is based upon and claims priority to Chinese Patent Application No. 202210482941.8, filed on May 5, 2022, the entire contents of which are incorporated herein by reference.

TECHNICAL FIELD

The present invention relates to the field of cosmetic containers, and in particular, to an airtight loose powder container.

BACKGROUND

Cosmetics are usually accommodated in portable cosmetic cases. A conventional powder case includes a case body, an inner cup, an outer lid, a powder puff, and an inner lid. The inner cup is provided in the box body. The powder puff is provided in the inner cup. The inner lid and the outer lid are taken as a whole. When the outer lid covers the case body and is screwed tightly, the inner lid is squeezed to seal the case body. However, there is no sealing between the powder puff and the case body, such that a volatile solvent in the powder gradually volatilizes through the powder puff, and the cosmetic material is hardened and deteriorated, thereby causing the waste.

SUMMARY

The present invention provides an airtight loose powder container to overcome the above deficiencies. The inner lid and the inner sifter hinged with each other are provided in the container. Under the squeezing force of the outer lid, the inner lid and the inner sifter can be tightly attached to each other, thereby ensuring the airtightness of the inner sifter and effectively preventing volatilization of a volatile solvent from the cosmetic material in the base.

To solve the technical problems, the present invention employs the following technical solutions.

An airtight loose powder container includes an outer lid, an inner lid, an inner sifter, and a base. The inner sifter is airtightly provided at an open end of the base, and the inner sifter is located between the inner lid and the base. The inner lid and the inner sifter are hinged through a hinge unit. The hinge unit is elastic, such that the inner lid under stress can move toward the inner sifter. When the outer lid covers the base, the outer lid squeezes the inner lid, such that the inner lid is airtightly attached to the inner sifter.

Optionally, the hinge unit may include a hinge shaft, a lug, and an elastic member. The hinge shaft may be provided on the inner lid. The inner sifter may be provided with an upper open end and a lower open end. A channel for allowing a material to pass through may be formed in the lower open end. The upper open end may extend upward to form the lug. A hinge hole and an aperture communicating with each other may be formed in the lug. The hinge shaft may be placed into the hinge hole through the aperture, such that the inner lid is hinged with the inner sifter. The elastic member for supporting the hinge shaft may further be provided on the lug.

Optionally, the hinge hole and the aperture may be located at an outer side or an inner side of the upper open end. The aperture may be located above or under the hinge hole. After the hinge shaft is placed into the hinge hole, the elastic member may be located under the hinge shaft.

Optionally, the elastic member may be an elastic claw integrally formed with the lug, and the elastic claw may be obliquely arranged at the aperture of the lug or arranged in the hinge hole.

Optionally, the elastic member may be a spring or a soft rubber member, and the spring or the soft rubber member may be provided in the lug.

Optionally, an outer diameter of the inner sifter may be greater than an inner diameter of the base. A convex ring may be formed at the upper open end of the inner sifter. The convex ring may be sleeved on the open end of the base. A soft rubber strip may be provided between the inner sifter and the base.

Optionally, the soft rubber strip may be provided between an upper sidewall of the open end of the base and a lower sidewall of the convex ring, or the soft rubber strip may be provided between an inner sidewall of the open end of the base and an outer sidewall of the inner sifter.

Optionally, the inner lid may be in a disk-like structure having a bottom plate. A protrusion may be provided on an outer sidewall of the inner lid. The hinge shaft may be provided on the protrusion. A gap may be formed between the hinge shaft and the outer sidewall of the inner lid. A soft rubber layer may be provided at a contact between the inner lid and the inner sifter.

Optionally, an internal thread may be provided on an inner sidewall of an open end of the outer lid, and an external thread matching with the internal thread may be provided on an outer sidewall of the open end of the base.

Optionally, the outer lid and the base may be in snap-fit connection or magnetic connection.

The present invention has the following beneficial effects:

1) The airtight loose powder container includes an outer lid, an inner lid, an inner sifter, and a base. The outer lid and the inner lid are separately arranged. A powder puff is placed into the inner lid. The base is configured to store a cosmetic material. The inner lid is hinged with the inner sifter. An elastic member is provided in a semi-closed hinge hole of the inner sifter, such that the opening/closing function of the hinge is ensured. The inner lid can move downward to some extent. When the outer lid covers the base and is locked, the inner lid is squeezed toward the inner sifter under the action of the outer lid. As a result, the inner lid and the inner sifter are tightly attached together for a squeezing force on a contact surface therebetween, thereby ensuring the airtightness of the inner sifter at the discharge place, effectively preventing the volatilization of a volatile solvent from the cosmetic material in the base and the powder material from spilling, and prolonging the service life of the cosmetic material.
2) As the outer diameter of the inner sifter is slightly greater than the inner diameter of the base, the inner sifter and the base are in interference fit after the inner sifter is placed into the base. Moreover, a soft rubber strip is provided at a contact between the inner sifter and the base. In this way, two sealing structures are provided between the inner sifter and the base, which ensures the airtightness between the inner sifter and the base and further improves the overall sealing performance of the container.
3) As the inner lid is hinged with the inner sifter, the inner lid is unnecessarily taken down in use, and is thus prevented from being contaminated. When the container is not used, the powder puff is placed into the inner lid without contacting the cosmetic material, which prevents the cosmetic material from penetrating into the powder puff excessively.

Figure 1:
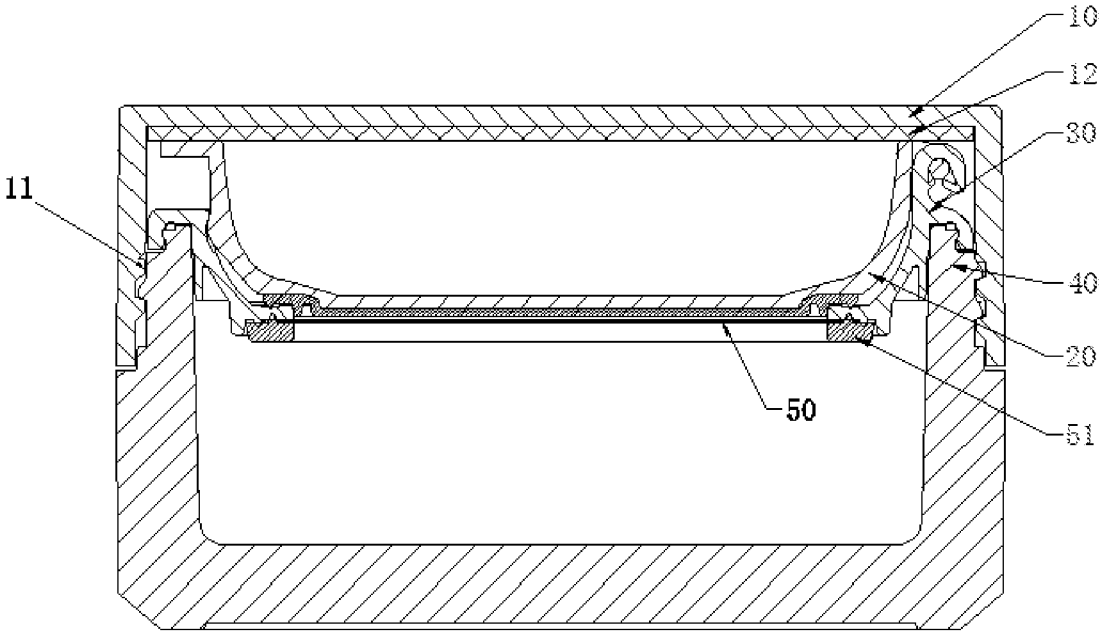
FIG. 1 is a schematic structural view according to the present invention.

In the figures: 10—outer lid, 11—internal thread, 12—gasket, 20—inner lid, 21—hinge shaft, 22—protrusion, 23—edge, 24—soft rubber layer, 30—inner sifter, 31—lug, 32—hinge hole, 33—elastic claw, 34—spring, 35—soft rubber member, 36—convex ring, 40—base, 41—external thread, 50—mesh fabric, 51—inner ring, and 60—soft rubber strip.

DETAILED DESCRIPTION OF THE EMBODIMENTS

The technical solutions in the embodiments of the present invention are clearly and completely described below with reference to the embodiments of the present invention. It will become apparent that the described embodiments are merely some, rather than all, of the embodiments of the present invention. All other embodiments obtained by those of ordinary skill in the art based on the embodiments of the present invention without creative efforts should fall within the protection scope of the present invention.

It should be noted that the terms "first", "second", and so on in the description and claims of this application and in the above accompanying drawings are intended to distinguish similar objects but do not necessarily indicate a specific order or sequence. It should be understood that the data used in such a way may be exchanged under proper conditions to make it possible to implement the described implementations of this application in sequences except those illustrated or described herein. Moreover, the terms "include", "contain", and any other variants mean to cover the non-exclusive inclusion, for example, a process, method, system, product, or device that includes a list of steps or units is not necessarily limited to those steps or units which are clearly listed but may include other steps or units which are not expressly listed or inherent to such a process, method, system, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (e.g., rotated by 90 degrees or in other orientations), but the relative description of the space will be explained accordingly.

As shown in FIGS. 1-12, an airtight loose powder container includes an outer lid 10, an inner lid 20, an inner sifter 30, and a base 40. The inner sifter 30 is airtightly provided at an open end of the base 40, and the inner sifter 30 is located between the inner lid 20 and the base 40. The inner lid 20 and the inner sifter 30 are hinged through a hinge unit. The hinge unit is elastic, such that the inner lid 20 under stress can move toward the inner sifter 30. When the outer lid 10 covers the base 40, the outer lid 10 squeezes the inner lid 20, such that the inner lid 20 is airtightly attached to the inner sifter 30. The outer lid 10 and the inner lid 20 are two separate components. A powder puff can be placed into the inner lid 20. The base 40 is configured to store a cosmetic material. The inner lid 20 is provided in the inner sifter 30. The inner lid is elastically hinged with the inner sifter, such that the inner lid can move downward to some extent, and the inner lid is further supported by a junction between the inner lid and the inner sifter to be more stable. When the outer lid 10 covers the base 40 and is locked, the inner lid 20 is squeezed toward the inner sifter 30 under the action of the outer lid 10. As a result, the inner lid 20 and the inner sifter 30 are tightly attached together for enough squeezing force on a contact surface therebetween, thereby ensuring the airtightness of the inner sifter, effectively preventing the volatilization of a volatile solvent from the cosmetic material in the base as well as the spillage of the powder material, and prolonging the service life of the cosmetic material. When the airtight loose powder container is used, the outer lid is opened, the powder puff is taken out, the inner lid 20 is opened by rotating it around the hinged place between the inner lid and the inner sifter by a certain angle, and the powder puff is used to dip the cosmetic material in the base, thereby completing a makeup process. As the inner lid is hinged with the inner sifter, the inner lid is unnecessarily taken down in use, and is thus prevented from being contaminated. When the airtight loose powder container is not used, the powder puff is placed into the inner lid without contacting the cosmetic material, which prevents the cosmetic material from penetrating into the powder puff excessively.

Figure 3:
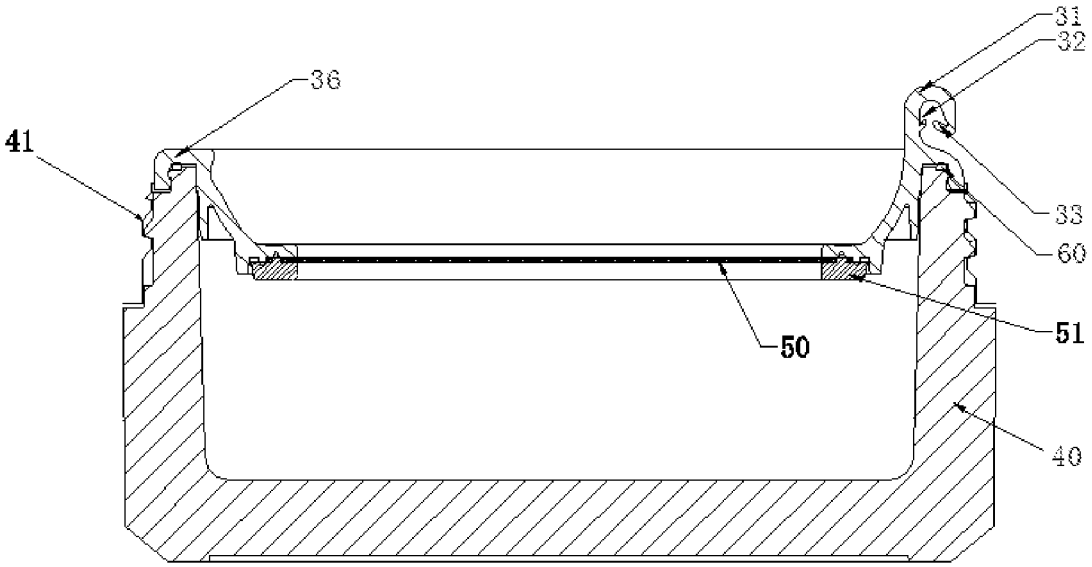
FIG. 3 is a schematic structural view of an inner sifter and a base according to the present invention.

As shown in FIG. 3, a hinge shaft 21 is provided on the inner lid 20. The inner sifter 30 is provided with an upper open end and a lower open end. A channel for allowing a material to pass through is formed in the lower open end. The upper open end extends upward to form the lug 31. A hinge hole 32 and an aperture communicating with each other are formed in the lug 31. The hinge shaft 21 is slid into the hinge hole 32 through the aperture, such that the inner lid 20 is hinged with the inner sifter 30. An elastic member for supporting the hinge shaft 21 is further provided on the lug 31. The hinge unit includes the hinge shaft 21, the lug 31, and the elastic member. The inner sifter is of an annular structure with the upper open end and the lower open end. The cosmetic material in the base 40 is discharged through the channel in the inner sifter for use by a user. The hinge shaft 21 on the inner lid is clamped into the hinge hole 32 through the aperture of the lug 31. The elastic member supports the hinge shaft 21. With the elasticity of the elastic member, the opening/closing function of the hinge unit is ensured, and the inner lid can move downward to some extent. The elastic member can be considered a part of the lug 31, namely the lug and the elastic member are integrally formed, or the elastic member and the lug 31 are two separate components. When the outer lid squeezes the inner lid, the inner lid presses the elastic member and moves downward, such that the inner lid is tightly attached to the inner sifter for sealing. The inner sifter is made of polypropylene (PP) or poly(diethylenetriamine terephthalamide) (PDTA).

Figure 4:
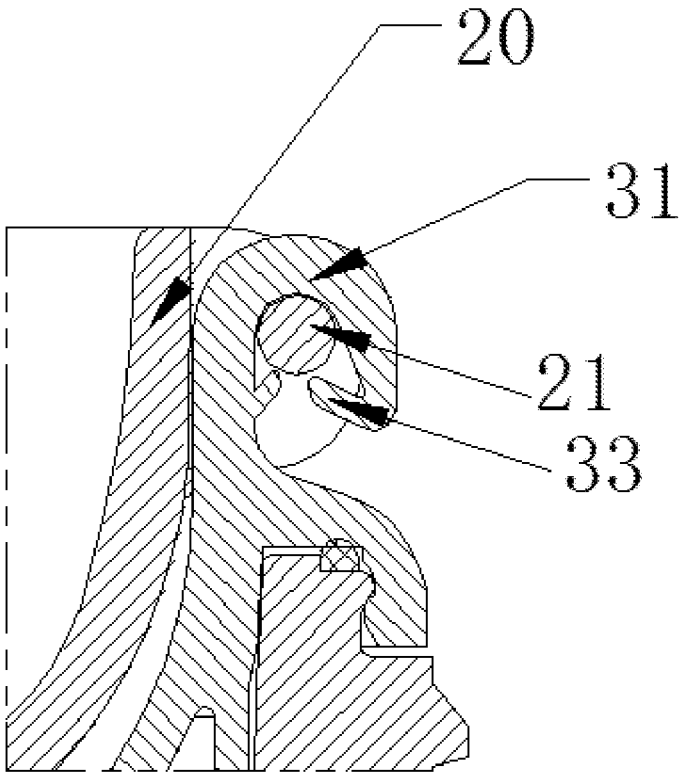
FIG. 4 is a partial schematic structural view according to Embodiment 1 of the present invention.
Figure 5:
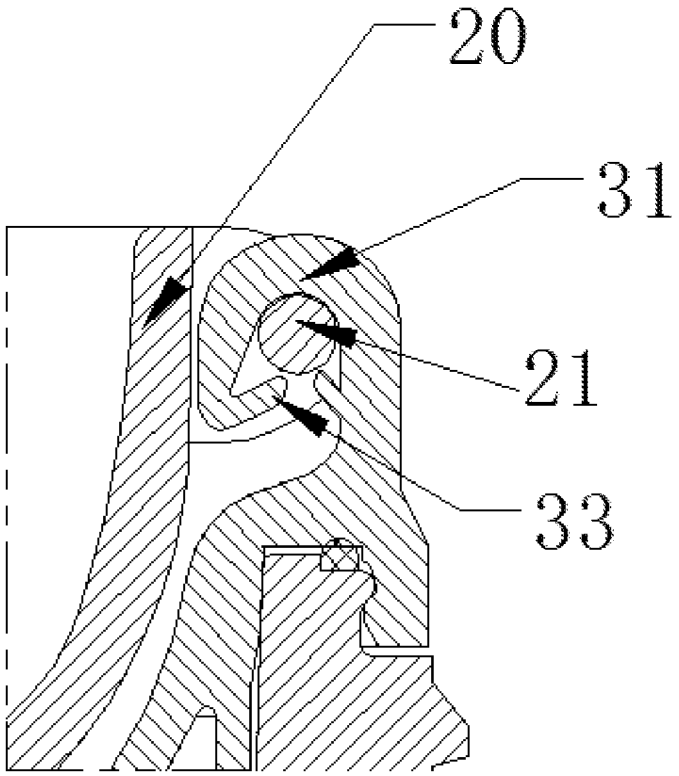
FIG. 5 is a partial schematic structural view according to Embodiment 2 of the present invention.
Figure 6:
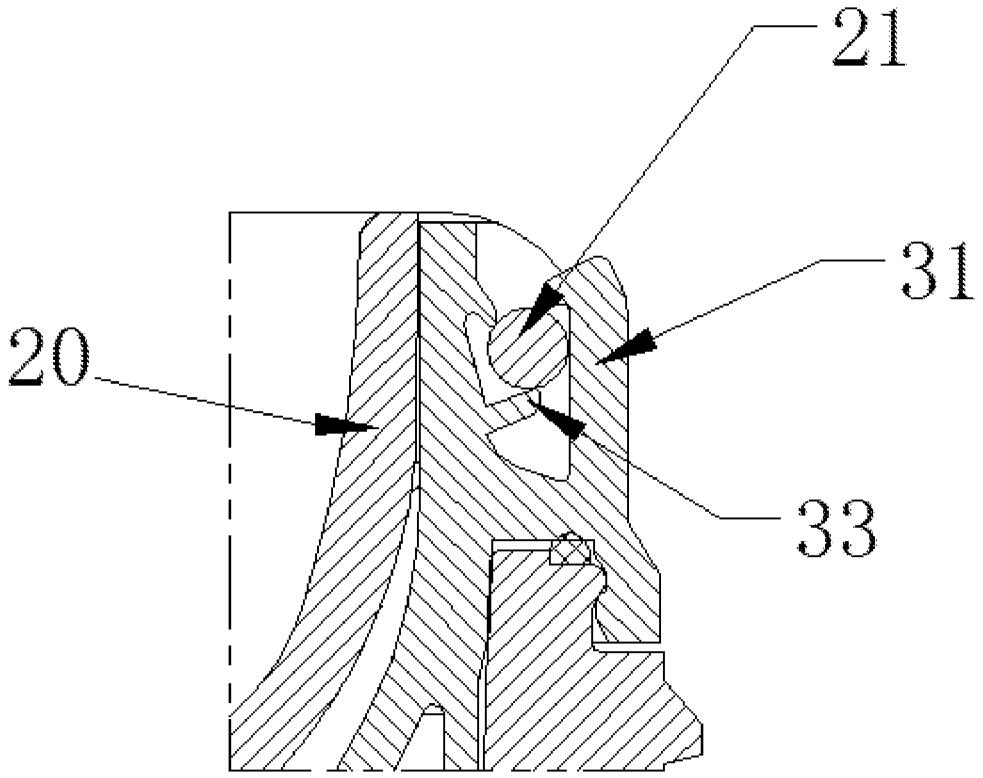
FIG. 6 is a partial schematic structural view according to Embodiment 3 of the present invention.

In Embodiment 1, as shown in FIG. 4, the hinge hole 32 and the aperture are located at an outer side or an inner side of the upper open end. The aperture is located above or under the hinge hole 32. After the hinge shaft 21 is placed into the hinge hole, the elastic member is located under the hinge shaft 21. The hinge hole 32 and the aperture are located at the outer side of the upper open end, and the aperture is located under the hinge hole. From the lower aperture at an outer side of the inner sifter, the hinge shaft 21 squeezes the elastic member and is placed into the hinge hole 32. In Embodiment 2, as shown in FIG. 5, the hinge hole 32 and the aperture are located at the inner side of the upper open end, and the aperture is located under the hinge hole. From the lower aperture at an inner side of the inner sifter, the hinge shaft 21 squeezes the elastic member and is placed into the hinge hole 32. In Embodiment 3, as shown in FIG. 6, the hinge hole 32 and the aperture are located at the outer side of the upper open end, and the aperture is located above the hinge hole. The hinge shaft 21 is placed into the hinge hole 32 from the upper aperture at an upper side of the inner sifter.

In Embodiments 1-3, the elastic member is an elastic claw 33 integrally formed with the lug 31. The elastic claw 33 is obliquely arranged at the aperture of the lug 31 or arranged in the hinge hole 32. The elastic member is the elastic claw 33. In Embodiments 1 and 2, as shown in FIGS. 4 and 5, the aperture is located under the hinge hole 32. The lug is provided thereon with two elastic claws 33 arranged left and right. The aperture is formed between the two elastic claws 33. The two elastic claws are obliquely arranged relative to a horizontal plane, such that the hinge shaft 21 is clamped into the hinge hole 32 through the aperture along the elastic claws. In Embodiment 3, as shown in FIG. 6, the aperture is located above the hinge hole 32. The lug is provided thereon with two elastic claws 33 arranged up and down, in which the upper elastic claw is located at the aperture, and the lower elastic claw is located in the hinge hole. The elastic claws are obliquely arranged relative to a horizontal plane. After the hinge shaft 21 is slid into the hinge hole 32 through the aperture along the upper elastic claw, the hinge shaft 21 is supported by the lower elastic claw 33. As the elastic claws are arranged obliquely, when the inner lid 20 is squeezed downward by the outer lid 10, the hinge shaft 21 on the inner lid presses the elastic claws and moves downward altogether, and thus the inner lid 20 and the inner sifter 30 are tightly attached together.

Figure 7:
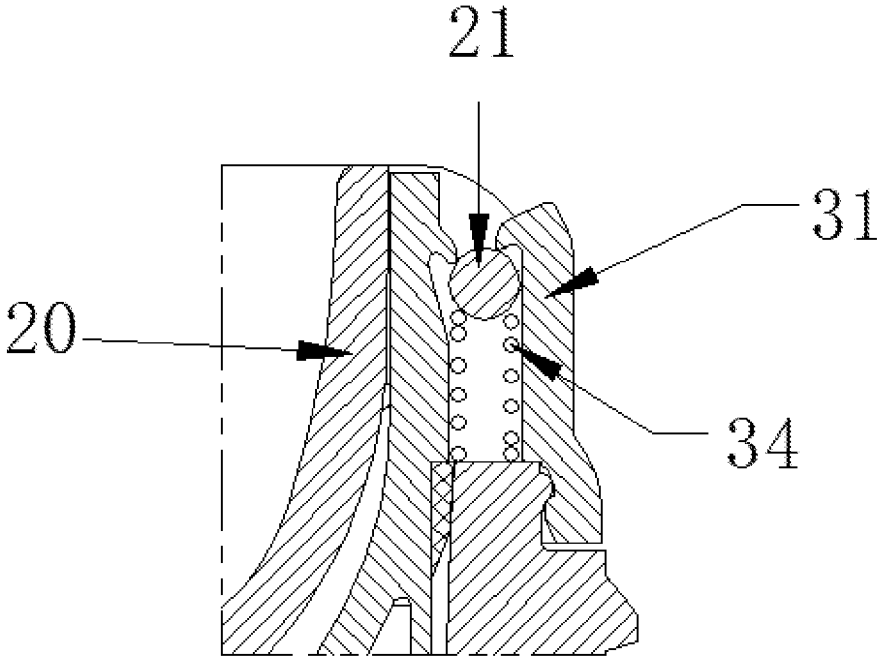
FIG. 7 is a partial schematic structural view according to Embodiment 4 of the present invention.
Figure 8:
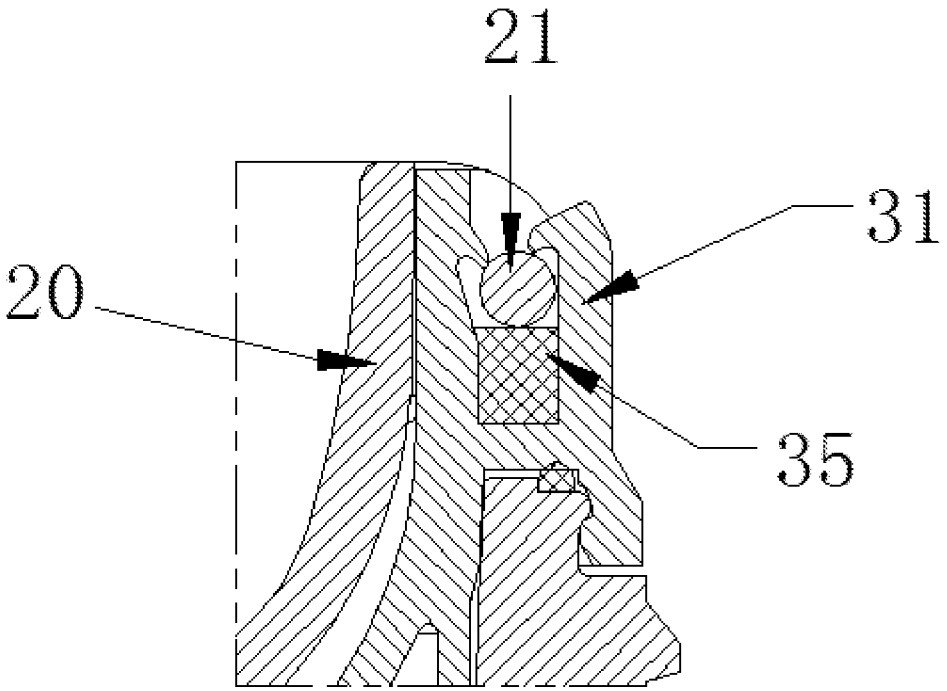
FIG. 8 is a partial schematic structural view according to Embodiment 5 of the present invention.

The elastic member is a spring 34 or a soft rubber member 35. The spring or the soft rubber member is provided in the lug 31. In Embodiment 4, as shown in FIG. 7, the elastic member is the spring 34. The spring is provided in the hinge hole 32 of the lug and located under the hinge shaft. In Embodiment 5, as shown in FIG. 8, the elastic member is the soft rubber member 35. The soft rubber member 35 is provided in the hinge hole 32 of the lug and located under the hinge shaft. In Embodiments 4 and 5, the aperture is located above the hinge hole 32. Likewise, when the inner lid 20 is squeezed downward by the outer lid 10, the hinge shaft 21 on the inner lid presses the spring 34 or the soft rubber member 35 and moves downward altogether, such that the inner lid 20 is tightly attached to the inner sifter 30.

As shown in FIG. 3, an outer diameter of the inner sifter 30 is greater than an inner diameter of the base 40. A convex ring 36 is formed at the upper open end of the inner sifter 30. The convex ring 36 is tightly sleeved on the open end of the base 40. A soft rubber strip 60 is provided between the inner sifter 30 and the base 40. The outer diameter of the inner sifter is slightly greater than the inner diameter of the base. After the inner sifter is placed into the base, the inner sifter and the base are in clearance fit to ensure the airtightness therebetween. The soft rubber strip at the contact between the inner sifter and the base becomes airtight. The soft rubber strip 60 is made of a thermoplastic polyester elastomer (TPEE). The soft rubber strip is not as hard as the inner sifter and the base.

Figure 9:
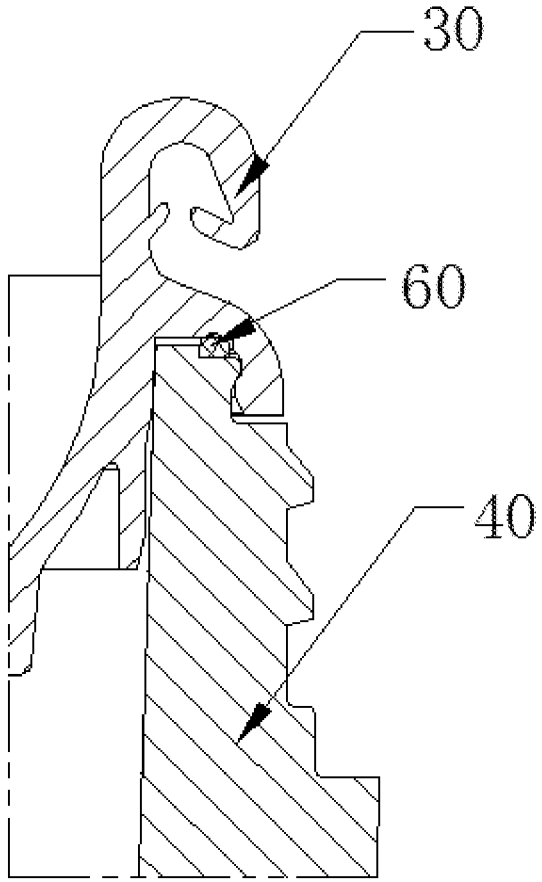
FIG. 9 is a partial schematic structural view according to Embodiment 6 of the present invention.
Figure 10:
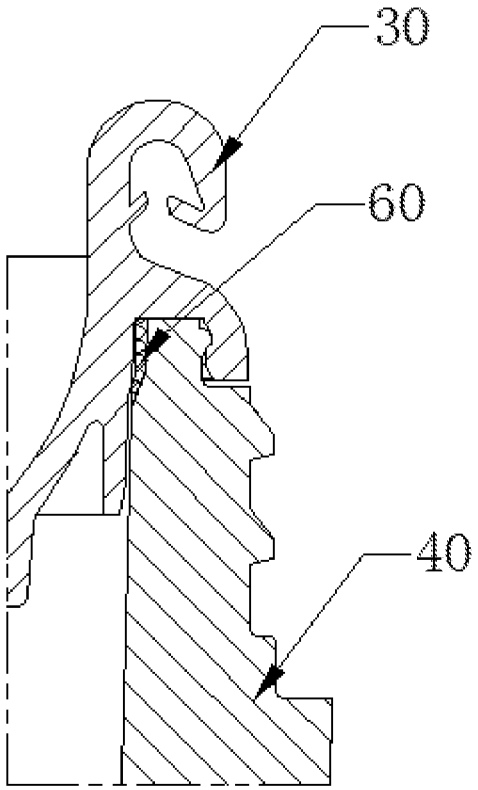
FIG. 10 is a partial schematic structural view according to Embodiment 7 of the present invention.
Figure 11:
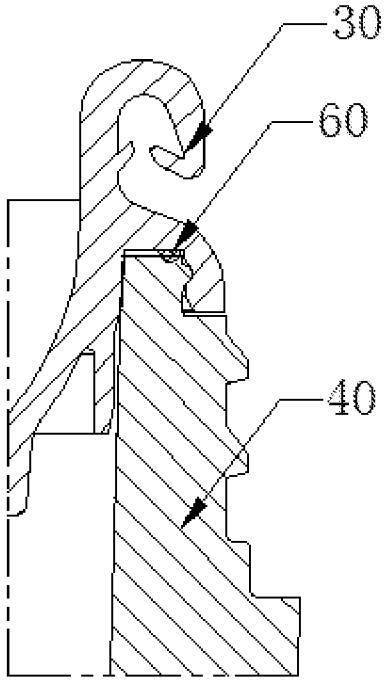
FIG. 11 is a partial schematic structural view according to Embodiment 8 of the present invention.
Figure 12:
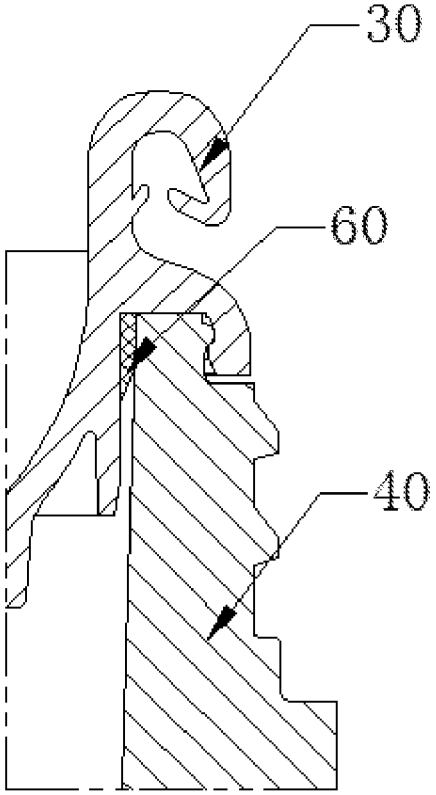
FIG. 12 is a partial schematic structural view according to Embodiment 9 of the present invention.

The soft rubber strip 60 is provided between an upper sidewall of the open end of the base and a lower sidewall of the convex ring 36, or the soft rubber strip 60 is provided between an inner sidewall of the open end of the base and an outer sidewall of the inner sifter 30. Optionally, the soft rubber strip 60 and the base 40 are integrally formed. Specifically, the soft rubber strip 60 and the base 40 are formed by two-color injection molding. In Embodiment 6, as shown in FIG. 9, the soft rubber strip is located on an upper sidewall of the base and integrally formed with the base. In Embodiment 7, as shown in FIG. 10, the soft rubber strip is located on an inner sidewall of the base and integrally formed with the base. Optionally, the soft rubber strip 60 and the inner sifter 30 are integrally formed. Specifically, the soft rubber strip 60 and the sifter 30 are formed by the two-color injection molding. In Embodiment 8, as shown in FIG. 11, the soft rubber strip is located on a lower sidewall of the inner sifter and integrally formed with the inner sifter. In Embodiment 9, as shown in FIG. 12, the soft rubber strip is located on the outer sidewall of the inner sifter and integrally formed with the inner sifter.

Figure 2:
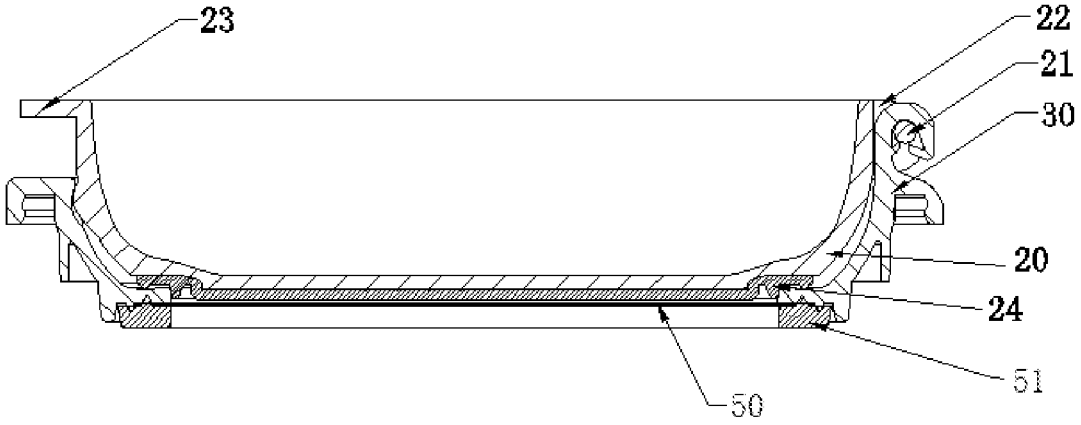
FIG. 2 is a schematic structural view of an inner lid and an inner sifter according to the present invention.

As shown in FIG. 2, the inner lid 20 is in a disk-like structure having a bottom plate. A protrusion 22 is provided on an outer sidewall of the inner lid 20. The hinge shaft 21 is provided on the protrusion 22. A gap is formed between the hinge shaft 21 and the outer sidewall of the inner lid 20. A soft rubber layer 24 is provided at a contact between the inner lid 20 and the inner sifter 30. The upper end of the inner lid 20 extends outward along a radial direction to form an edge 23. The protrusion 22 is provided on the outer sidewall of the inner lid 20. The hinge shaft 21 is provided on the protrusion 22. The soft rubber layer 24 may be provided at an edge of the contact between the inner lid 20 and the inner sifter 30. As shown in FIG. 2, the soft rubber layer may also be provided on a lower sidewall of the whole bottom plate of the inner lid. The soft rubber layer 24 may be discontinuously point-like or continuously sheet-like. The soft rubber layer 24 may also be of a planar structure, namely the soft rubber layer is provided at the entire contact between the inner lid and the inner sifter, and may also be of an annular structure, namely a plurality of annular soft rubber layers are provided at the contact between the inner lid and the inner sifter. The soft rubber layer 24 may be integrally formed with the inner lid 20 by the two-color injection molding, or the soft rubber layer is integrally formed with the inner sifter by the two-color injection molding, provided that the inner lid contacts the inner sifter flexibly. Optionally, the lower open end of the inner sifter 30 is provided with a mesh fabric 50. The mesh fabric 50 is welded at a bottom of the inner sifter 30 through an inner ring 51. A plurality of powder outlets are formed in the mesh fabric 50. The soft rubber layer on the inner lid is tightly attached to the mesh fabric, such that there is an enough pressure for the inner lid and the powder outlets on the inner sifter to ensure the sealing function.

The inner lid 20 is configured to store the powder puff. The hinge shaft 21 and the outer sidewall of the inner lid 20 are approximately parallel to each other with a gap therebetween for placing the hinge shaft into the lug of the inner sifter 30. For a better sealing effect, the soft rubber layer 24 is directly attached to the inner sifter and the mesh fabric. The inner lid is made of the PDTA, while the soft rubber layer is made of the TPEE. Alternatively, the inner lid is made of the PP while the soft rubber layer is made of polyethylene (PE). The soft rubber layer 24 is not as hard as the inner lid and the inner sifter.

In some implementations, an internal thread 11 is provided on an inner sidewall of an open end of the outer lid 10. An external thread 41 matching with the internal thread 11 is provided on an outer sidewall of the open end of the base 40. A gasket 12 is provided between the outer lid 10 and the inner lid 20. The outer lid and the base may be fixed by a bolt and a hinge. The outer lid is made of poly (ethylene terephthalateco-1,4-cylclohexylenedimethylene terephthalate (PETG), the base is made of poly(1,4-cyclohexanedimethylene terephthalic acid) (PCTA), and the gasket is made of PE foam.

In other implementations, the outer lid 10 and the base 40 are in snap-fit connection or magnetic connection. The snap-fit connection may be specifically achieved as follows. A convex ring and a clamping groove clamped to each other are provided on the outer lid 10 and the base 40, respectively. The convex ring between the outer lid and the base is directly clamped into the clamping groove in assembly. Alternatively, a button and a circular ring clamped to each other are provided between the outer lid and the base. The button is clamped into the circular ring in assembly. The button is pressed in use, such that the button is separated from the circular ring. Magnets or a magnet and an iron sheet that are attracted to each other may also be provided on the outer lid and the base, respectively. In assembly, the outer lid and the base are connected by a magnetic force of the magnet.

The present invention has the following operation process: In use of the airtight loose powder container, the outer lid 10 is screwed off, the powder puff is taken out, the inner lid 20 is opened by rotating it around the hinged place between the inner lid and the inner sifter by a certain angle. The powder puff is used to dip the cosmetic material in the base, thereby completing a makeup process. After use, the inner lid 20 is rotated around the hinged place oppositely, such that the inner lid is placed into the inner sifter 30. The outer lid 10 is screwed tightly to the base. The outer lid 10 squeezes the inner lid 20, such that the soft rubber layer 24 of the inner lid 20 is tightly attached to the inner sifter 30, and the discharge channel between the inner lid and the inner sifter is sealed. Moreover, the inner sifter 30 and the base 40 are in clearance fit with the soft rubber strip at the contact therebetween, thereby ensuring the airtightness between the inner sifter 30 and the base 40.

It should be noted that those of ordinary skill in the art can further make variations and improvements without departing from the concept of the present invention. These variations and improvements all fall within the protection scope of the present invention. Therefore, the protection scope of the present invention should be subject to the protection scope defined by the claims.

What is claimed is:

1. An airtight loose powder container, comprising an outer lid, an inner lid, an inner sifter and a base, wherein the inner sifter is airtightly provided at an open end of the base, and the inner sifter is located between the inner lid and the base; the inner lid and the inner sifter are hinged through a hinge unit; the hinge unit is elastic, such that the inner lid under stress moves toward the inner sifter; and when the outer lid covers the base, the outer lid squeezes the inner lid, such that the inner lid is airtightly attached to the inner sifter;

wherein the hinge unit comprises a hinge shaft, a lug, and an elastic member; the hinge shaft is provided on the inner lid; the inner sifter is provided with an upper open end and a lower open end; a channel for allowing a material to pass through is formed in the lower open end; the upper open end extends upward to form the lug; a hinge hole and an aperture communicating with each other are formed in the lug; the hinge shaft is placed into the hinge hole through the aperture, such that the inner lid is hinged with the inner sifter; and the elastic member for supporting the hinge shaft is further provided on the lug; and wherein the elastic member comprises two elastic claws, each of the elastic claws is obliquely arranged relative to a horizontal plane, such that the hinge shaft is clamped into the hinge hole through the aperture along the elastic claws, and a free end of both of the elastic claws points to the hinge shaft when the hinge shaft is clamped in the hinge hole.

2. The airtight loose powder container according to claim 1, wherein the hinge hole and the aperture are located at an outer side of the upper open end; the aperture is located under the hinge hole; and after the hinge shaft is placed into the hinge hole, the elastic member is located under the hinge shaft.

3. The airtight loose powder container according to claim 2, wherein the elastic member is a spring or a soft rubber member, wherein the spring or the soft rubber member is provided in the lug.

4. The airtight loose powder container according to claim 2, wherein an outer diameter of the inner sifter is greater than an inner diameter of the base; a convex ring is formed at the upper open end of the inner sifter; the convex ring is sleeved on the open end of the base; and a soft rubber strip is provided between the inner sifter and the base.

5. The airtight loose powder container according to claim 4, wherein the soft rubber strip is provided between an upper sidewall of the open end of the base and a lower sidewall of the convex ring, or the soft rubber strip is provided between an inner sidewall of the open end of the base and an outer sidewall of the inner sifter.

6. The airtight loose powder container according to claim 1, wherein the inner lid is in a disk-like structure having a bottom plate; a protrusion is provided on an outer sidewall of the inner lid; the hinge shaft is provided on the protrusion; a gap is formed between the hinge shaft and the outer sidewall of the inner lid; and a soft rubber layer is provided at a contact between the inner lid and the inner sifter.

7. The airtight loose powder container according to claim 1, wherein an internal thread is provided on an inner sidewall of an open end of the outer lid, and an external thread matching with the internal thread is provided on an outer sidewall of the open end of the base.

8. The airtight loose powder container according to claim 1, wherein the outer lid and the base are in snap-fit connection or magnetic connection.

* * * * *